US009865414B2

(12) United States Patent
Tsukimori et al.

(10) Patent No.: US 9,865,414 B2
(45) Date of Patent: Jan. 9, 2018

(54) LIMIT SWITCH

(71) Applicant: OMRON Corporation, Kyoto-shi, Kyoto (JP)

(72) Inventors: Kazuyuki Tsukimori, Okayama (JP); Manabu Takahashi, Okayama (JP); Yuki Yamamoto, Okayama (JP)

(73) Assignee: OMRON Corporation, Kyoto-shi (JP)

( * ) Notice: Subject to any disclaimer, the term of this patent is extended or adjusted under 35 U.S.C. 154(b) by 0 days.

(21) Appl. No.: 14/948,423

(22) Filed: Nov. 23, 2015

(65) Prior Publication Data

US 2016/0189894 A1 Jun. 30, 2016

(30) Foreign Application Priority Data

Dec. 24, 2014 (JP) ..... 2014-261336

(51) Int. Cl.

| | |
|---|---|
| ***H01H 3/16*** | (2006.01) |
| ***H01H 3/18*** | (2006.01) |
| ***H01H 15/14*** | (2006.01) |
| ***H01H 17/12*** | (2006.01) |
| ***H01H 19/18*** | (2006.01) |
| ***H01H 21/28*** | (2006.01) |

(Continued)

(52) U.S. Cl.

CPC ..... *H01H 21/22* (2013.01); *H01H 21/28* (2013.01); *H01H 21/36* (2013.01); *H01H 3/42* (2013.01); *H01H 2235/01* (2013.01)

(58) Field of Classification Search

CPC ..... H01H 3/16; H01H 3/18; H01H 15/14; H01H 17/12; H01H 19/18; H01H 21/28; H01H 21/285; H01H 2021/287; H01H 21/22; H01H 21/36; H01H 3/42; H01H 2235/01; H01H 71/1052; H01H 3/00; H01H 3/02; H01H 3/04; H01H 3/06; H01H 3/08; H01H 3/10; H01H 3/32; H01H 3/38; H01H 3/40; H01H 3/46; H01H 2001/12; H01H 2003/00; H01H 2001/02; H01H 2001/32; H01H 2001/40; H01H 2001/46; H01H 2009/0088; H01H 2009/0094; H01H 2009/002; H01H 2009/20; H01H 9/04; Y10T 74/2102; Y10T 74/1896; G05G 1/08

USPC ..... 200/47; 74/107, 568 R

See application file for complete search history.

(56) References Cited

U.S. PATENT DOCUMENTS 3,688,593 A * 9/1972 Ustin ..... G05G 1/08 200/47
2014/0000409 A1 1/2014 Hayase et al.
2014/0360849 A1 12/2014 Takahashi et al.

FOREIGN PATENT DOCUMENTS

CN 2093435 U 1/1992
CN 103515136 A 1/2014

(Continued)

OTHER PUBLICATIONS

Chinese Office Action dated May 27, 2017 in the counterpart Chinese patent application.

*Primary Examiner* — Anthony R. Jimenez
(74) *Attorney, Agent, or Firm* — Metrolexis Law Group, PLLC

(57) ABSTRACT

A limit switch is provided that is returned to an original position even if a turning angle of a turning lever becomes 90 degrees. In a section perpendicular to a turning shaft, a cam is formed such that a whole contact surface of the cam with a cam receiver is located on a side of the cam receiver with respect to a shaft center of the turning shaft when the external force does not act on the turning lever.

5 Claims, 9 Drawing Sheets

(51) Int. Cl.

| | |
|---|---|
| ***H01H 21/22*** | (2006.01) |
| ***H01H 21/36*** | (2006.01) |
| *H01H 3/42* | (2006.01) |

(56) References Cited

FOREIGN PATENT DOCUMENTS

| | | | |
|---|---|---|---|
| CN | 104025232 | A | 9/2014 |
| DE | 1920273 | A1 | 11/1970 |
| JP | H06-056733 | B2 | 7/1994 |
| JP | H11-149847 | A | 6/1999 |
| JP | H11-238430 | A | 8/1999 |
| JP | H11-250768 | A | 9/1999 |

* cited by examiner

LIMIT SWITCH

CROSS-REFERENCE TO RELATED APPLICATION

This application is based on Japanese Patent Application No. 2014-261336 filed with the Japan Patent Office on Dec. 24, 2014, the entire contents of which are incorporated herein by reference.

FIELD

The present invention relates to a limit switch used as a sensor for positioning or object detection in production facilities or industrial machines.

BACKGROUND

Conventionally, for example, a limit switch disclosed in JP 11-238430 A is well known as this kind of limit switch. The limit switch disclosed in JP 11-238430 A is one called a roller arm type.

As illustrated in FIGS. 9A, 9B, and 10, in a limit switch 100 disclosed in JP 11-238430 A, an actuator 103 is coupled to one end of a main shaft 102 supported in a container body 101, and a roller 104 that is in contact with a detected object is attached to a leading end of the actuator 103. The detected object abuts on the roller 104 to turn the actuator 103 together with the main shaft 102, and a cam 105 coupled to the main shaft 102 is turned together with the main shaft 102 in the container body 101. A plunger 107 includes a cam follower 106 that is located at a leading end of the plunger 107 to abut on a circumferential surface of the cam 105, whereby the plunger 107 moves linearly. The plunger 107 is coupled to an operating shaft 109 of a built-in switch 108 in which a contact is opened and closed by a pressing operation. When the plunger 107 moves linearly in association with the turning of the cam 105, the operating shaft 109 is pressed to open and close the built-in switch 108.

SUMMARY

However, the conventional limit switch has the following problem.

In the limit switch 100 disclosed in JP 11-238430 A, a contact surface of the cam 105 with the cam follower 106 is partially located above a shaft center of the main shaft 102. For example, when the actuator 103 is turned by 90 degrees, a line of action of a force in a returning direction in which the plunger 107 is linearly returned upward by a returning spring 111 is matched with a shaft center of the cam 105. For this reason, moment is not generated with respect to the cam 105. The cam 105 cannot be turned, which results in a problem in that the actuator 103 of the turning lever cannot be returned to an original position.

An object of the present invention is to provide a limit switch that is returned to the original position even if the turning angle of the turning lever becomes 90 degrees.

According to one aspect of the present invention, a limit switch includes: a turning lever configured to turn by receiving an external force; a displacement member including a cam and a cam receiver, the cam being provided in a turning shaft of the turning lever to be turned in response to turning of the turning shaft that is in contact with the cam, the cam receiver being in contact with the cam, the cam receiver being pressed by the turning cam to linearly displace a position of the displacement member; a switch module configured to perform on and off operations by the linear displacement of the displacement member; and a biasing member configured to bias the displacement member and the turning lever so as to return the displacement member and the turning lever to original positions when the external force is released. At this point, in a section perpendicular to the turning shaft, the cam is formed such that a whole contact surface of the cam with the cam receiver is located on a cam receiver side with respect to a shaft center of the turning shaft when the external force does not act on the turning lever.

In a section perpendicular to the turning shaft, the cam is formed such that a whole contact surface with the cam receiver is located on a cam receiver side with respect to a shaft center of the turning shaft when the external force does not act on the turning lever.

For example, when the turning lever is turned by 90 degrees, the cam is also turned by 90 degrees in response to the turning of the turning shaft. At a position where the cam is turned by 90 degrees, the cam is eccentric with respect to the shaft center of the turning shaft in the section perpendicular to the turning shaft. Resultantly, a line of action of the force in a returning direction in which the displacement member is linearly returned onto a cam side by the biasing member is not matched with the shaft center of the cam. For this reason, moment is generated with respect to the cam. Even if the turning lever is turned by 90 degrees, the cam can be turned in the returning direction, and the turning lever can be returned to the original position.

Accordingly, the limit switch that is returned to the original position even if the turning angle of the turning lever becomes 90 degrees can be provided.

In the limit switch, the cam is formed by partially cutting a sectional circular portion in a lengthwise direction of the turning shaft, a sectional shape of the cam includes a first chord passing through a point on an outer circumferential side with respect to a center of a circular section in the sectional circular portion, and the cam includes a section including a portion on an outer circumferential side with respect to the first chord.

Therefore, the cam, which is formed such that the whole contact surface with the cam receiver of the cam is located on the cam receiver side with respect to the shaft center of the turning shaft when the external force does not act on the turning lever in the section perpendicular to the turning shaft, can be provided as a specific example.

The first chord is formed so as to be linearly symmetrical with respect to the turning lever. Resultantly, when the external force acts on the turning lever, the cam is normally and reversely turned even if the turning lever is normally and reversely turned. Accordingly, the limit switch in which the turning lever is normally and reversely turned can be provided.

In the limit switch, the cam includes a section formed between the first chord and a second chord, the second chord being provided on an outer circumferential side with respect to the first chord and being parallel to the first chord.

The second chord is in contact with the cam receiver. At this point, the second chord is linearly formed. Therefore, when the external force does not act on the turning lever, a bottom including a flat surface of the second chord of the cam is in contact with a top including a flat surface of the cam receiver. Resultantly, when the external force does not act on the turning lever, the cam is stably in contact with the flat surface of the cam receiver. Accordingly, the limit switch in which the turning lever is stably held when the external force does not act on the turning lever can be provided.

In the limit switch, the turning shaft is connected to the turning lever including a roller at a leading end, a detected object to which the external force is applied abuts on the roller and presses the roller to turn the turning shaft through the turning lever, and the turning lever and the first chord of the cam are disposed so as to be orthogonal to each other.

For example, in the case that the given position of the turning lever is set to a vertical direction when the external force does not act on the turning lever, the first chord of the cam is oriented toward a horizontal direction. Resultantly, the turning lever can surely be turned even when the turning lever is normally or reversely turned up to 90 degrees.

Accordingly, the present invention can provide the limit switch that is returned to the original position even if the turning angle of the turning lever becomes 90 degrees.

DETAILED DESCRIPTION

Hereinafter, a preferred embodiment of the present invention will be described with reference to FIGS. 1 to 8.

The limit switch according to an embodiment is one in which a microswitch is assembled in a metal or resin case for protection against an external force, water, oil, dust, and the like. The limit switch detects a position, a change, movement, or passage of a detected object, and outputs an on or off signal based on whether the position, the change, movement, or passage is detected.

Figure 2:
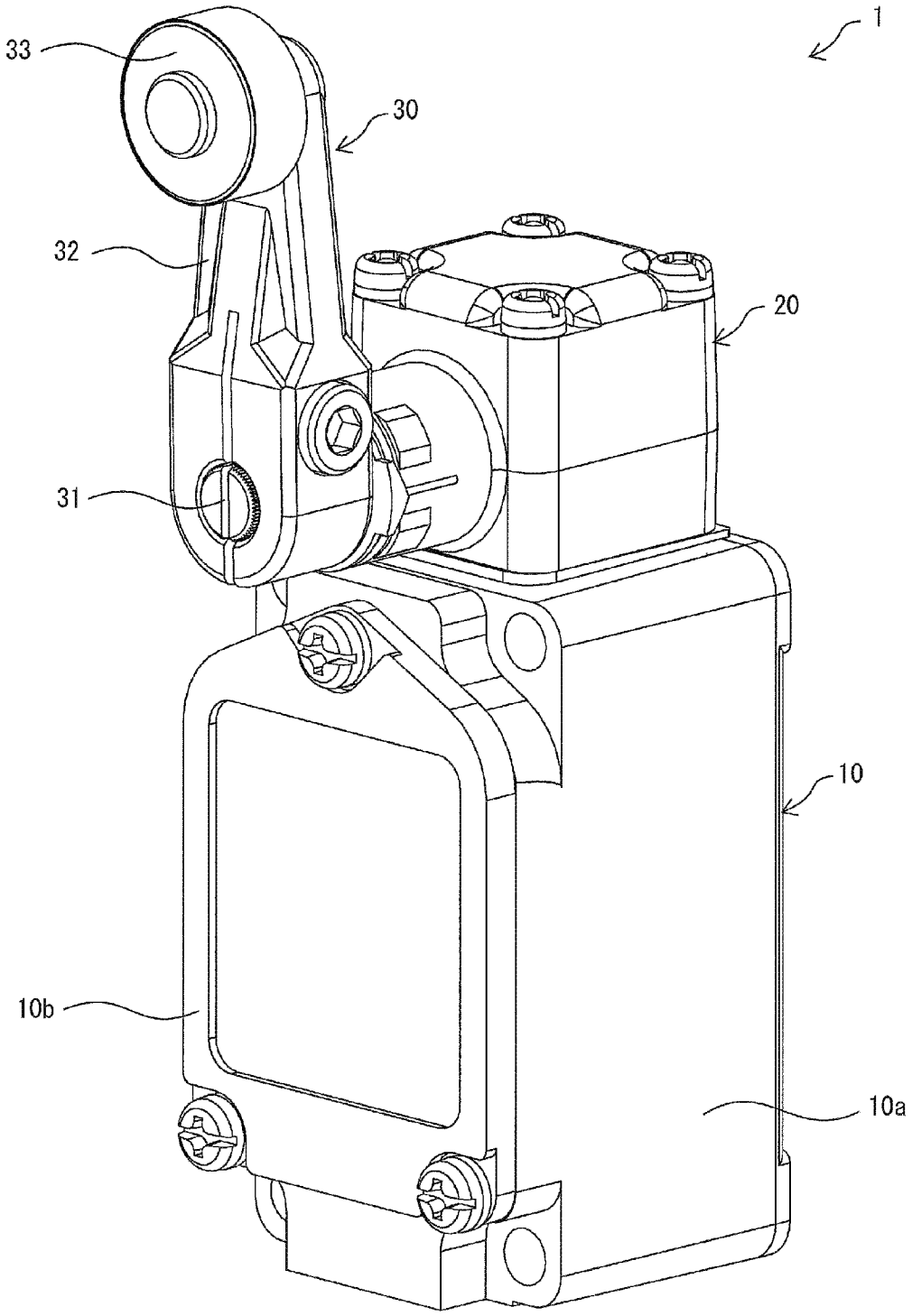
FIG. 2 is a perspective view illustrating an appearance configuration of the limit switch.
Figure 3:
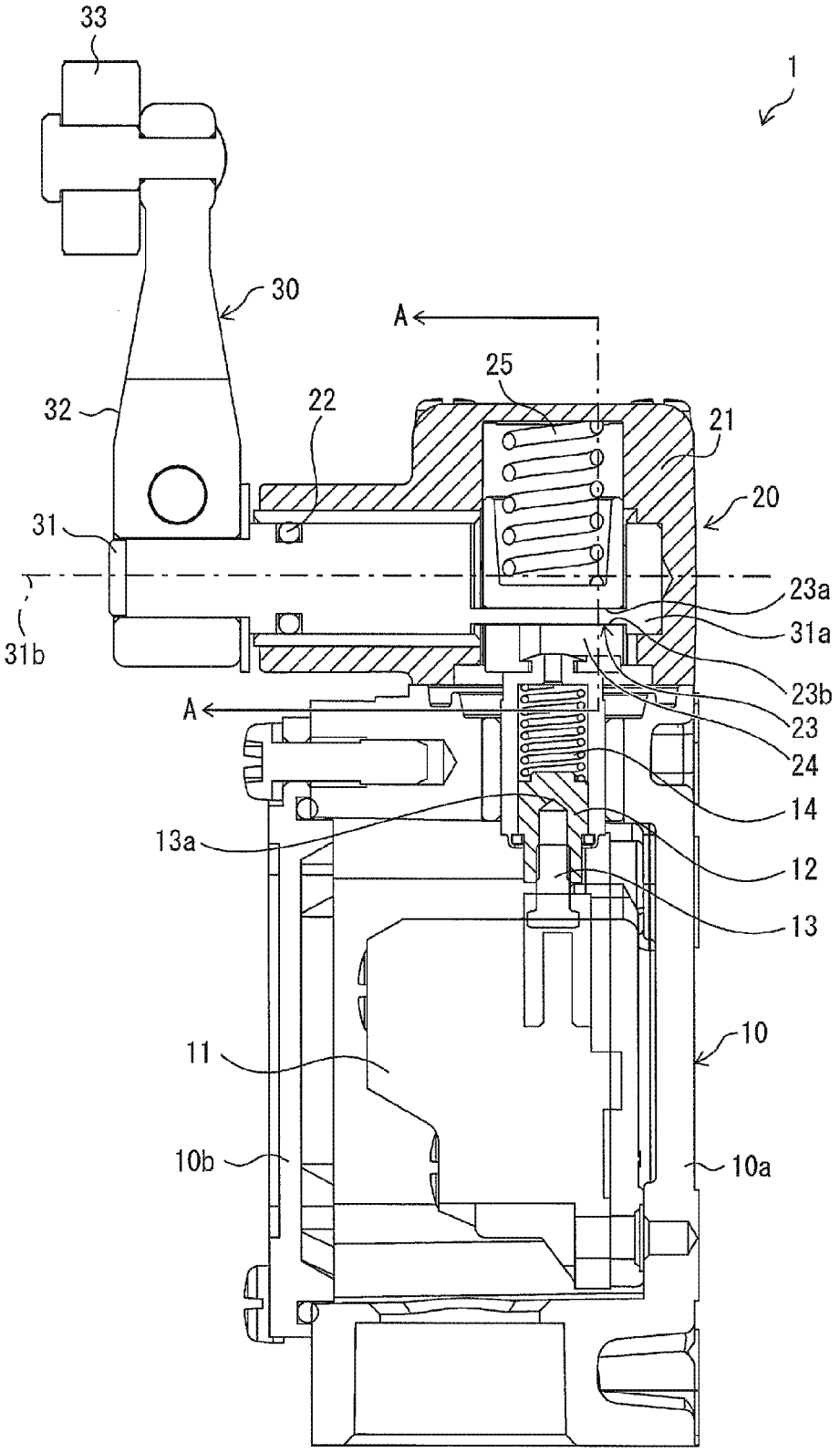
FIG. 3 is a sectional side view illustrating a configuration of the limit switch.

A configuration of a limit switch 1 of the embodiment will be described with reference to FIGS. 2 and 3. FIG. 2 is a perspective view illustrating an appearance configuration of the limit switch 1. FIG. 3 is a sectional side view illustrating a configuration of the limit switch 1.

As illustrated in FIGS. 2 and 3, the limit switch 1 includes a housing 10, a cam-incorporated block 20, and an actuator 30.

A switching mechanism 11 of a switch module is disposed in an internal space of the housing 10, and protects the switching mechanism 11 from the external force, the water, the oil, the dust, and the like. The housing 10 includes a housing body 10*a* and a lid 10*b*. The housing body 10*a* includes an opening through which the switching mechanism 11 is assembled in the internal space. The lid 10*b* is used to close the opening. The lid 10*b* is attached to the housing body 10*a* after internal wiring of the housing 10 is performed, thereby ensuring a sealing property of the housing 10. There is no particular limitation to a material of the housing 10, but the housing 10 is made of resin or metal.

The cam-incorporated block 20 is attached to a top of the housing 10, and a mechanism that converts turning movement of a turning lever 32 of the actuator 30 into linear movement using a cam 23 is incorporated in the cam-incorporated block 20.

The actuator 30 includes a turning shaft 31, a turning lever 32, and a roller 33 with which the detected object comes into contact.

The actuator 30 projects laterally from the cam-incorporated block 20, and a given position of the actuator 30 is a position at which a force generated by the contact with the detected object is not applied from the outside. In the embodiment, the given position of the actuator 30 is one that is oriented toward 00:00 of a clock.

In the limit switch 1 of the above configuration, the turning lever 32 is turned clockwise based on the given position when the force is applied to the roller 33 of the actuator 30 in FIG. 2 from a left direction. Then, the turning lever 32 returns to the given position when the force is removed. On the other hand, the turning lever 32 returns counterclockwise based on the given position when the force is applied to the actuator 30 from a right direction in FIG. 2. Then, the turning lever 32 returns to the given position when the force is removed. As described later, the switching mechanism 11 operates by the turning of the turning lever 32 of the actuator 30.

A detailed internal structure of the limit switch 1 will be described below.

As illustrated in FIG. 3, a plunger 12, an operating shaft 13, and a plunger returning spring 14 are provided in the housing 10 of the limit switch 1. The plunger 12 is vertically supported in the housing body 10*a*, and the cam 23 existing at an end in a lengthwise direction of the turning shaft 31 of the actuator 30 is in contact with an end in a lengthwise direction of the plunger 12 while a cam receiver 24 and the plunger returning spring 14 are interposed therebetween.

In order to return the pressed-down plunger 12 to a reference position, a biasing force is applied to the operating shaft 13 by the plunger returning spring 14 including, for example, a coil spring. The reference position of the plunger 12 is a position, where the plunger 12 is held by the operating shaft 13 while the operating shaft 13 is raised up to a limit by the plunger returning spring 14.

At this point, the cam 23 also returns by the returning of the turning lever 32 of the actuator 30, and the cam 23 applies the force to the plunger 12 in the lengthwise direction of the plunger 12 with the cam receiver 24 interposed therebetween. Resultantly, the plunger 12 is displaced along the lengthwise direction from the reference position, and downwardly drives an upper end 13*a* of the operating shaft 13 exposed from a ceiling surface of the switching mechanism 11, thereby pressing down the operating shaft 13.

When the turning lever 32 of the actuator 30 returns to the given position, the plunger 12 also returns to the reference position by the biasing force of the plunger returning spring 14. A contact (not illustrated) included in the switching mechanism 11 is opened and closed by the displacements of the plunger 12 and operating shaft 13.

For example, the switching mechanism 11 includes a photo interrupter or a mechanical switch, to performs on and off operations by the turning of the turning lever 32.

The cam-incorporated block 20 of the limit switch 1 will be described below with reference to FIGS. 2 and 3.

As illustrated in FIGS. 2 and 3, the cam-incorporated block 20 includes a block casing 21, the turning shaft 31, a bearing 22, the cam 23, the cam receiver 24, and a cam returning spring 25. The turning shaft 31, a bearing 22, the cam 23, the cam receiver 24, and a cam returning spring 25 are provided in the block casing 21.

As described above, one of the ends of the turning shaft 31 is connected to the turning lever 32, and the other end is rotatably supported by the block casing 21. Specifically, the turning shaft 31 is formed into a circular shape in section in the cam-incorporated block 20, and the turning shaft 31 is rotatably supported by the bearing 22 provided in an inner wall of the block casing 21 on the side of the turning lever 32 of the cam-incorporated block 20. The turning shaft 31 includes a disc supported part 31*a* at a leading end on the opposite side to the turning lever 32 of the cam-incorporated block 20. The disc supported part 31*a* is formed into a disc shape, and a center of the disc is matched with a shaft center 31*b* of the turning shaft 31. The disc supported part 31*a* is turnably fitted in a cylindrical recess bearing 21*a* formed in a vertical wall of the block casing 21. Resultantly, the turning shaft 31 is rotatably supported by the bearing 22 of the cam-incorporated block 20 and the cylindrical recess bearing 21*a*.

The cam receiver 24 is in contact with a lower end surface of the cam 23, and transfers the pressing force received by the contact with the cam 23 to the plunger 12 through the plunger returning spring 14 as described above.

For example, the cam returning spring 25 includes a coil spring. When the cam 23 provided at a lower portion of the turning shaft 31 is turned in association with the turning of the turning lever 32, the cam returning spring 25 abuts on the cam 23 and presses the cam 23 such that the cam 23 returns to the original state, namely, the given position of the turning lever 32.

Figure 1:
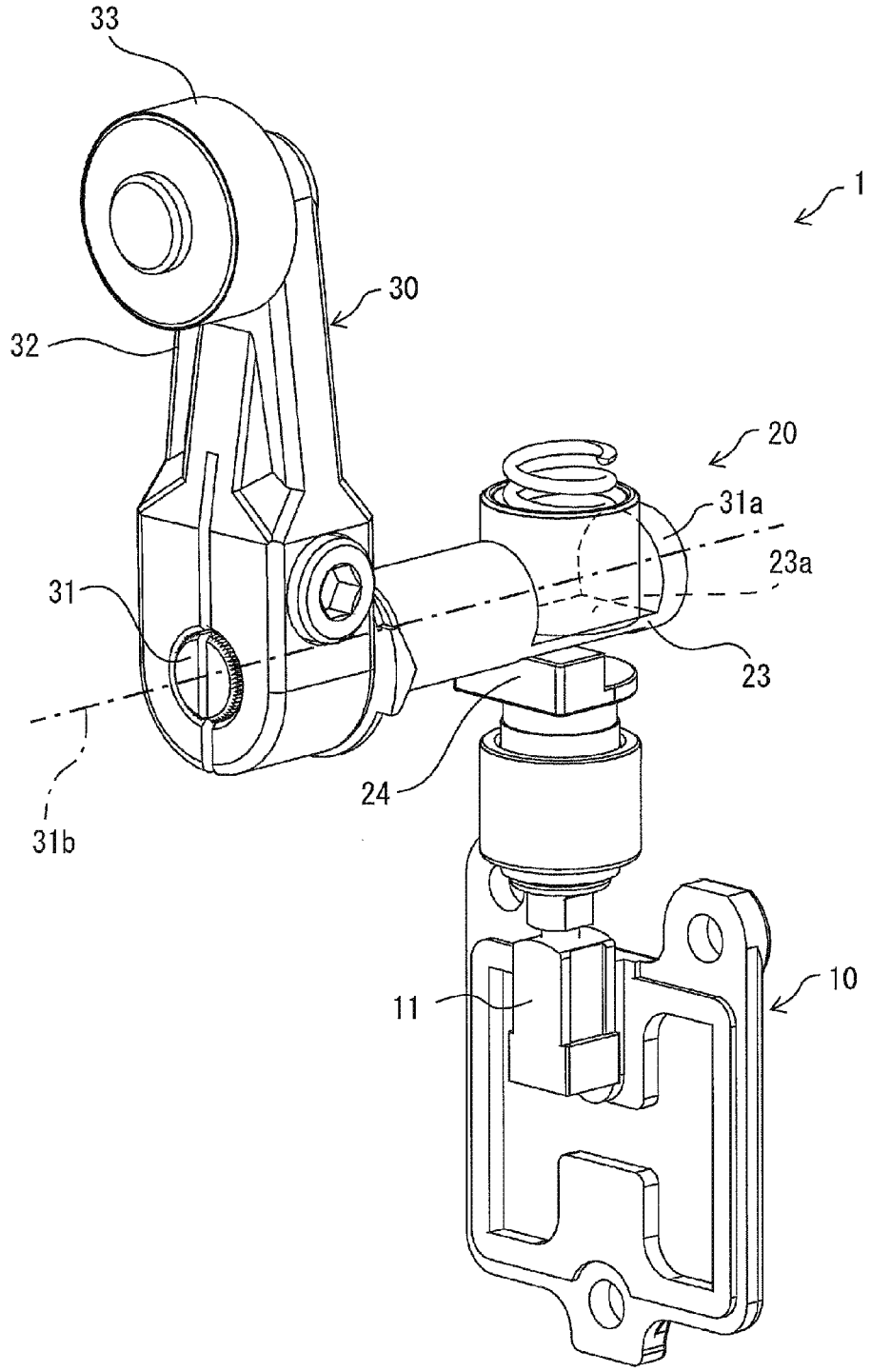
FIG. 1 is a perspective view illustrating a configuration of a main part of a limit switch according to an embodiment of the present invention.
Figure 4:
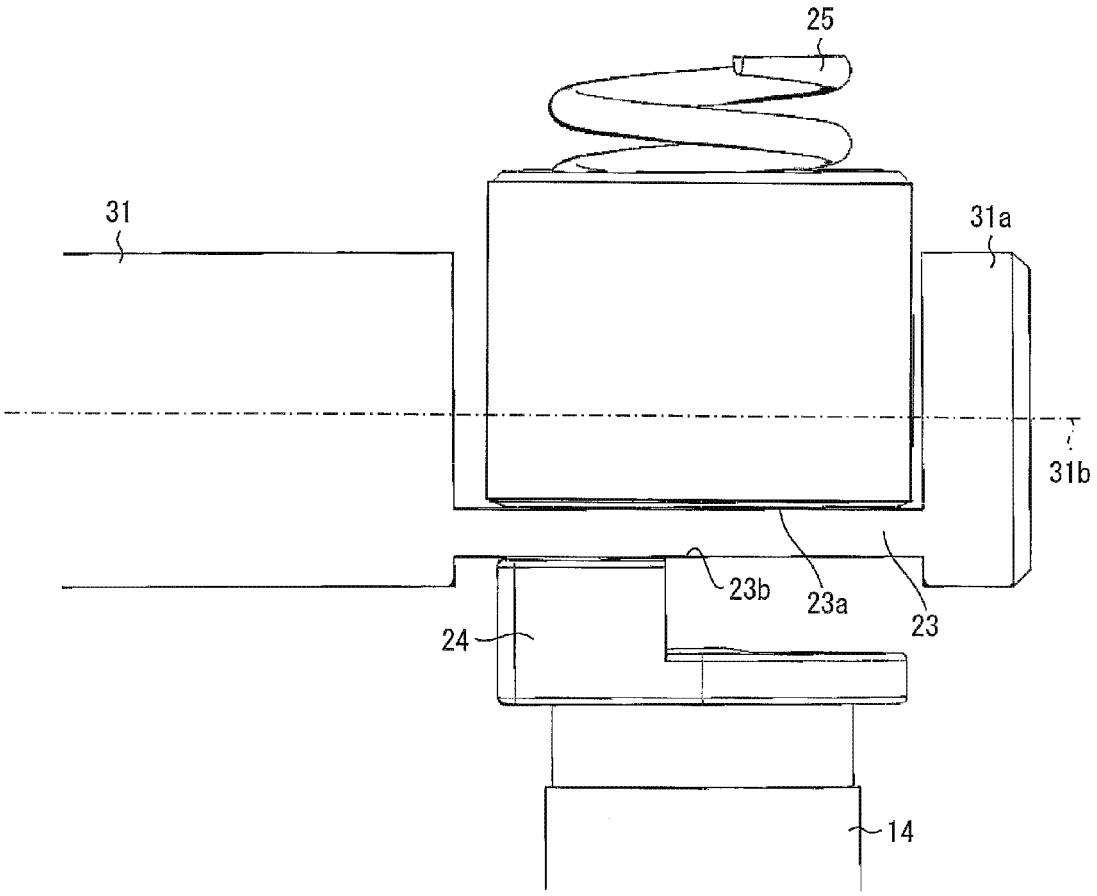
FIG. 4 is a side view illustrating a configuration of a main part of a cam in a cam-incorporated block of the limit switch.
Figure 5:
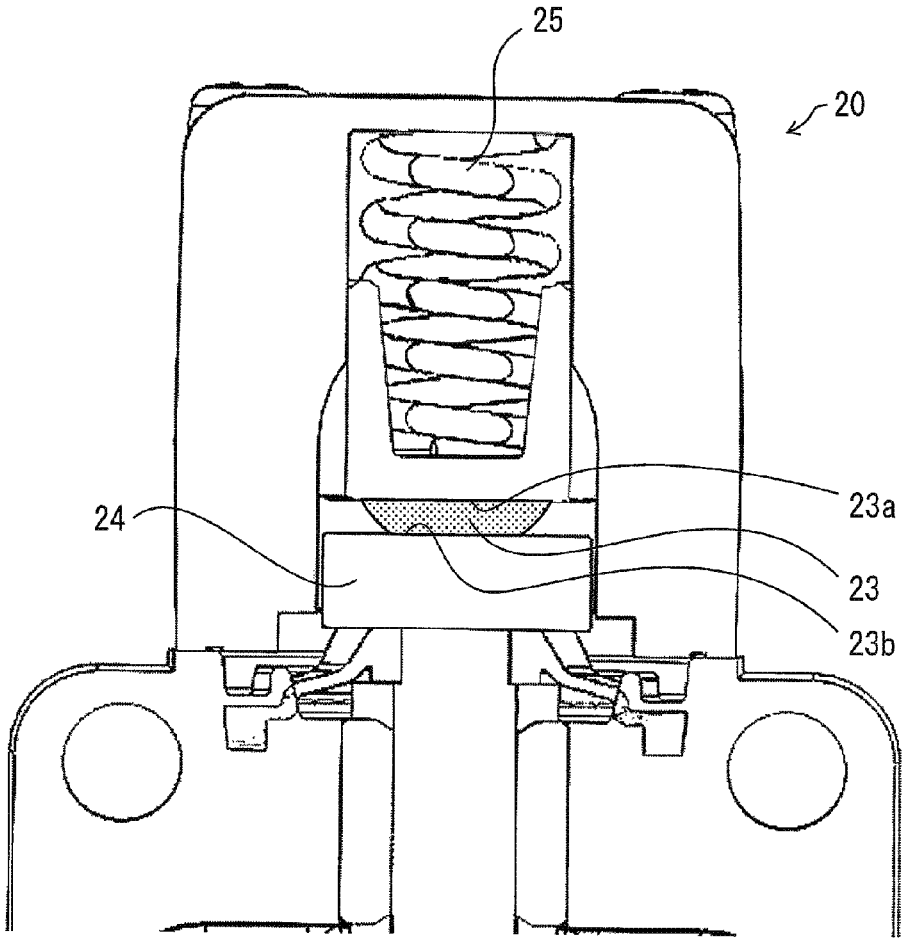
FIG. 5 is a sectional view illustrating an internal configuration of the cam-incorporated block of the limit switch, and taken along a line A-A of FIG. 3.

The detailed configuration of the cam 23 will be described with reference to FIGS. 1, 4, and 5. FIG. 1 is a perspective view illustrating a configuration of a main part of the limit switch 1. FIG. 4 is a side view illustrating a configuration of a main part of the cam 23 in a cam-incorporated block 20 of the limit switch 1. FIG. 5 is a sectional view illustrating an internal configuration of the cam-incorporated block 20 of the limit switch 1, and taken along a line A-A of FIG. 3.

As illustrated in FIG. 1, in the section perpendicular to the turning shaft 31, the cam 23 is formed such that a second chord 23*b* that is a whole contact surface of the cam 23 with the cam receiver 24 is located on the side of the cam receiver 24 with respect to the shaft center 31*b* of the turning shaft 31 when the external force does not act on the turning lever 32.

Specifically, as illustrated in FIG. 4, the cam 23 is formed by partially cutting a sectional circular portion in a lengthwise direction of the turning shaft 31, a sectional shape of the cam 23 includes a first chord 23*a* passing through a point on an outer circumferential side with respect to a center of a circular section in the sectional circular portion, and the cam 23 includes a section including a portion on an outer circumferential side with respect to the first chord 23*a*.

In the embodiment, the cam 23 includes a section formed between the first chord 23*a* and the second chord 23*b*. The second chord 23*b* is provided on an outer circumferential side with respect to the first chord 23*a* and is parallel to the first chord 23*a*.

That is, as illustrated in FIG. 5, the cam 23 includes the section in which a portion except for the center of the circle is cut by the first and second chords 23*a* and 23*b* parallel to each other.

At this point, the first chord 23*a* of the cam 23 is in contact with the lower end of the cam returning spring 25, and the second chord 23*b* of the cam 23 is in contact with the upper end of the cam receiver 24. As illustrated in FIG. 1, the turning lever 32 of the actuator 30 is located at the given position where the external force does not act on the turning lever 32. Resultantly, at the given position of the turning lever 32, the turning lever 32 and the first and second chords 23*a* and 23*b* of the cam 23 are disposed so as to be orthogonal to each other.

Figure 6A:
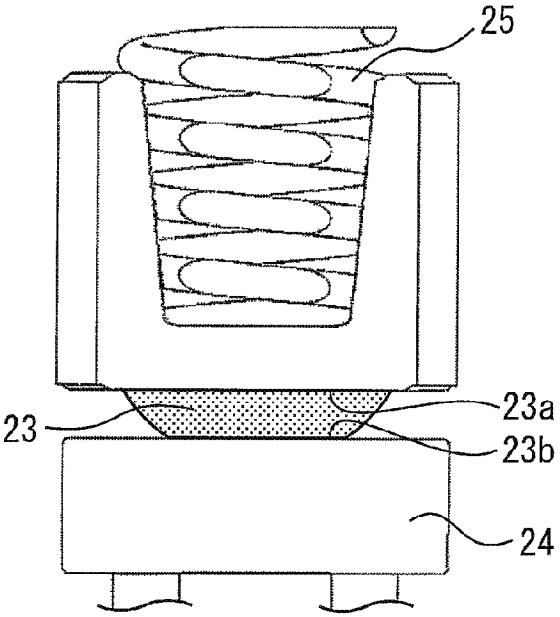
FIG. 6A is a front view illustrating a disposition state of the cam when a turning lever is located at a given position.
Figure 6B:
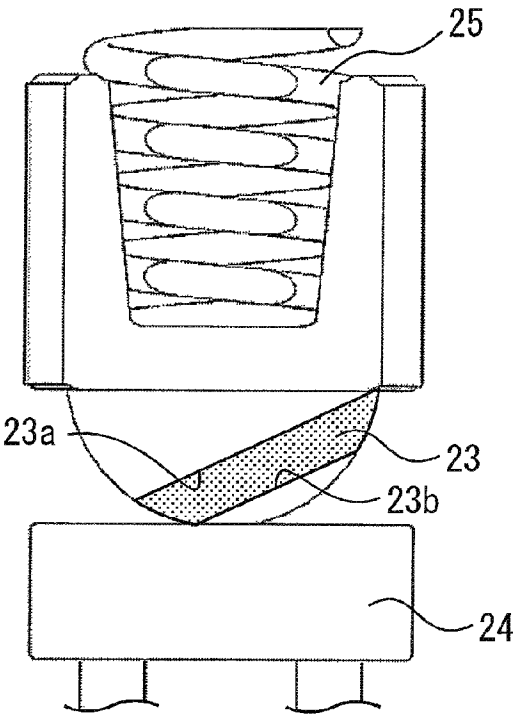
FIG. 6B is a front view illustrating a state, in which an external force acts on a roller to slightly turn the turning lever and the cam is slightly turned in association with the turning of the turning lever.
Figure 6C:
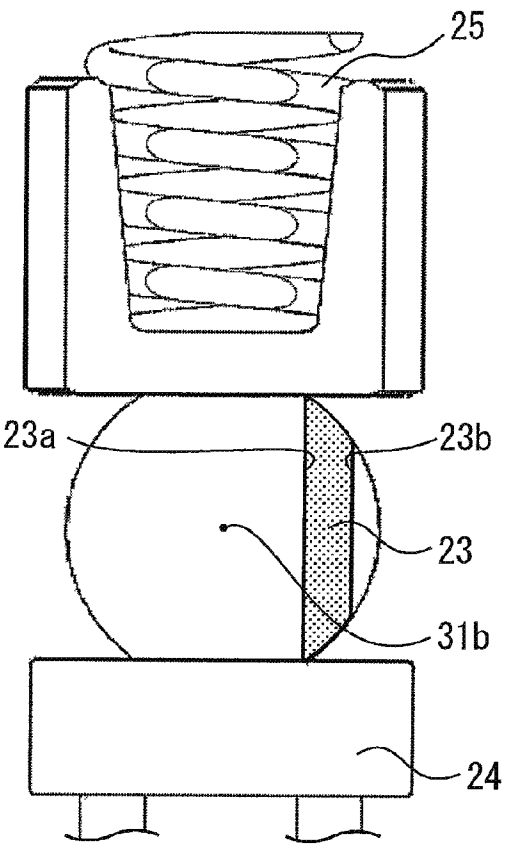
FIG. 6C is a front view illustrating a state of the cam when the turning lever is turned by 90 degrees.

An operation of the cam 23 having the above configuration will be described with reference to FIGS. 6A, 6B, and 6C. FIG. 6A is a front view illustrating a disposition state of the cam 23 when the turning lever 32 is located at the given position. FIG. 6B is a front view illustrating a state, in which an external force acts on the roller 33 to slightly turn the turning lever 32 and the cam 23 is slightly turned in association with the turning of the turning lever 32. FIG. 6C is a front view illustrating a state of the cam 23 when the turning lever 32 is turned by 90 degrees.

As illustrated in FIG. 6A, when the turning lever 32 exists at the given position, namely, when the turning lever 32 exists in a vertical direction, the first chord 23*a* of the cam 23 abuts parallelly on a bottom of the cam returning spring 25, and the second chord 23*b* of the cam 23 abuts on the top of the cam receiver 24. Accordingly, the turning lever 32 is stably held at the given position in the vertical direction because the first and second chords 23*a* and 23*b* of the cam 23 abut on the flat bottom of the cam returning spring 25 and the flat top of the cam receiver 24.

At this point, the turning lever 32 is turned when a detected object (not illustrated) abuts on the roller 33 of the actuator 30 in FIG. 1 to press the roller 33. Therefore, as illustrated in FIG. 6B, the cam 23 is turned about the shaft center 31*b*. Then, for example, when the turning lever 32 of the actuator 30 in FIG. 1 is turned by 90 degrees, the cam 23 abuts vertically on the bottom of the cam returning spring 25 and the top of the cam receiver 24 as illustrated in FIG. 6.

Figure 7:
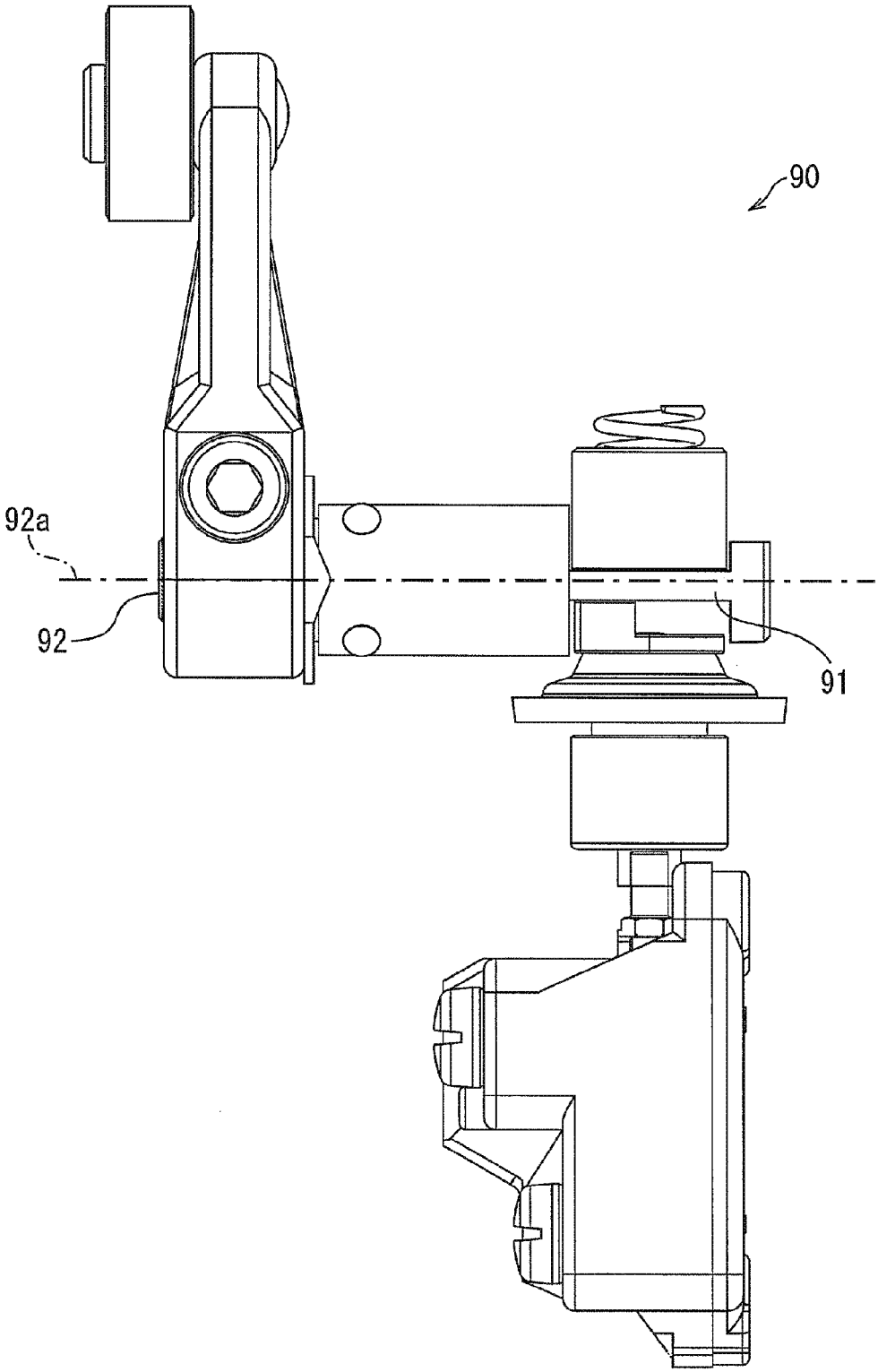
FIG. 7 is a side view illustrating a limit switch of a comparative example, and illustrating a configuration of the limit switch of the comparative example in which a sectional shape of the cam is included in a shaft center of a turning shaft.
Figure 8:
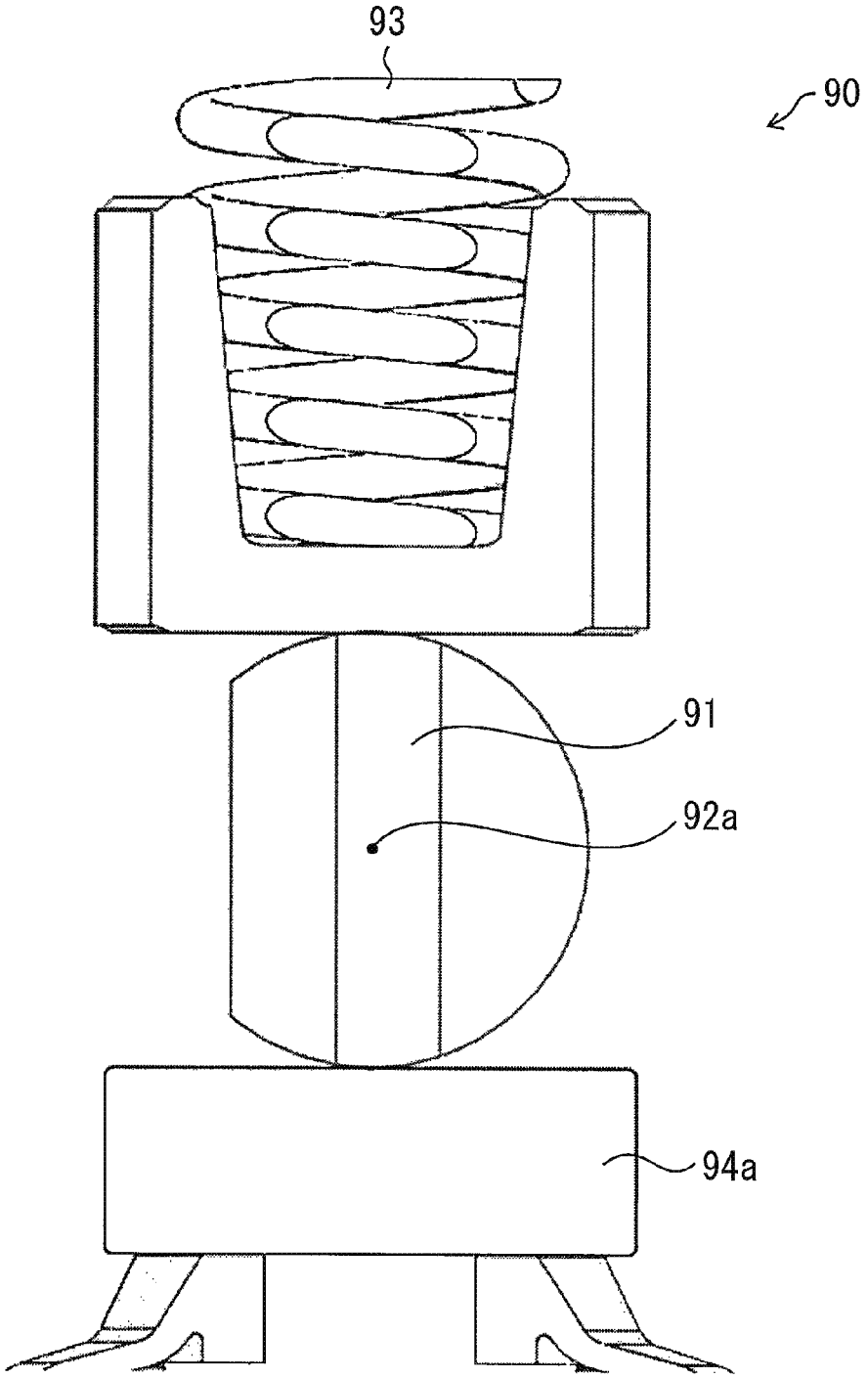
FIG. 8 is a front view illustrating a configuration of a main part of the limit switch of the comparative example when the turning lever is turned by 90 degrees.
Figure 9A:
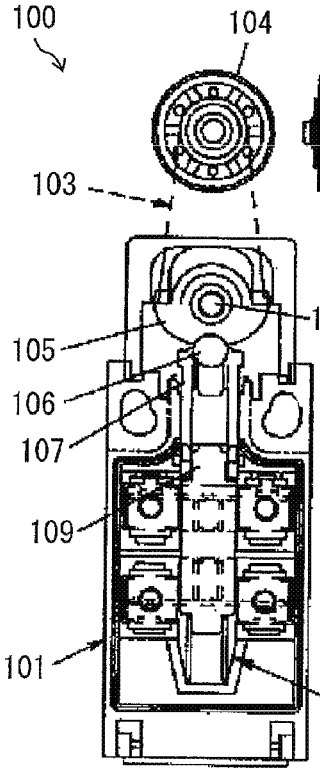
FIG. 9A is a front view illustrating a configuration of a conventional limit switch.
Figure 9B:
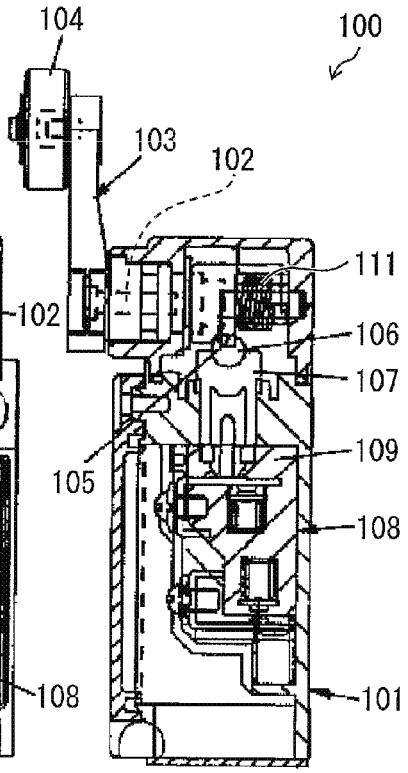
FIG. 9B is a side view illustrating the configuration of the conventional limit switch.
Figure 10:
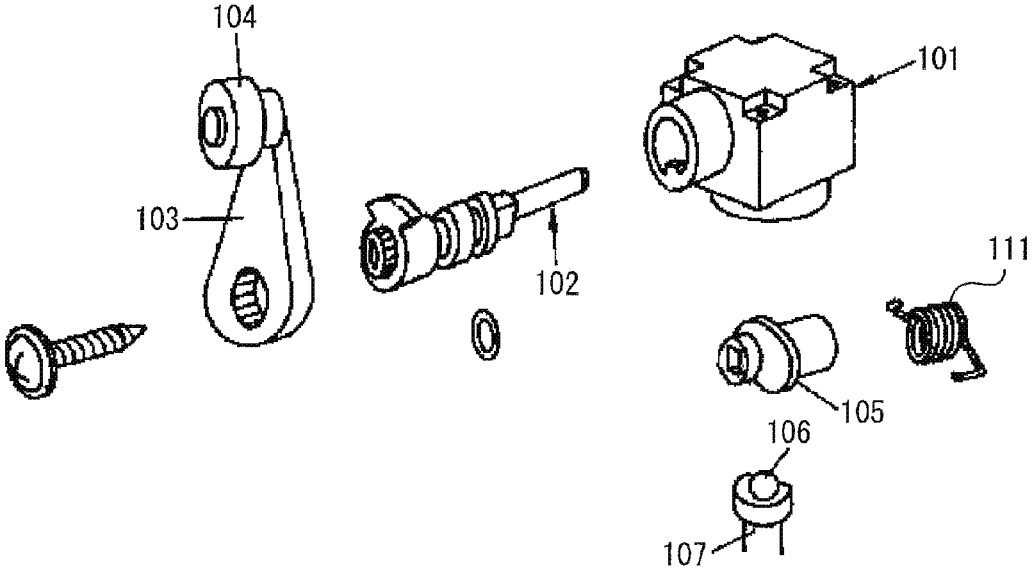
FIG. 10 is an exploded perspective view illustrating a main part of the conventional limit switch.

At this point, for example, for a limit switch 90 in which a sectional shape of a cam 91 that is of a comparative example is included in a shaft center 91*a* of a turning shaft 92 as illustrated in FIG. 7, the cam 91 cannot be turned when the cam 91 abuts on a bottom of a returning spring 93 and a top of a cam receiver 94 as illustrated in FIG. 8. That is because a line of action of the bias of the returning spring 93 is matched with a center line parallel to a lengthwise direction of the cam 91, a turning force is not generated in the cam 23. Resultantly, for the limit switch 90 in which the sectional shape of the cam 91 that is of the comparative example is included in the shaft center 91*a* of the turning shaft 92, the turning lever cannot be turned by 90 degrees.

On the other hand, in the limit switch 1 of the embodiment, the cam 23 is provided so as to be eccentric with respect to the shaft center 31*b* of the turning shaft 31 as illustrated in FIG. 6C. In FIG. 6C, when the cam returning spring 25 applies the pressing force to the cam 23, clockwise moment acts about the shaft center 31*b*. Accordingly, the cam 23 is turned so as to be returned to the given position of the turning lever 32, so that the cam 23 can be returned to the original state in FIG. 6A.

That is, in the limit switch 1 of the embodiment, the cam 23 can sufficiently be returned to the given position even if the turning lever 32 is turned by 90 degrees or slightly more.

Thus, the limit switch 1 of the embodiment includes: the turning lever 32 configured to turn by receiving the external force; the plunger 12 of the displacement member including the cam 23 and the cam receiver 24, the cam 23 being provided in the turning shaft 31 of the turning lever 32 to be turned in response to the turning of the turning shaft 31 that is in contact with the cam 23, the cam receiver 24 being in contact with the cam 23; the cam receiver 24 being pressed by the turning cam 23 to linearly displace the position of the plunger 12; the switching mechanism 11 of the switch module configured to perform the on and off operations by the linear displacement of the plunger 12; and the cam returning spring 25 and coil spring 14 configured to bias the displacement member and the turning lever so as to return the plunger 12 and the turning lever 32 to the original positions when the external force is released. In the section perpendicular to the turning shaft 31, the cam 23 is formed such that the whole contact surface of the cam 23 with the cam receiver 24 is located on the side of the cam receiver 24 with respect to the shaft center 31*b* of the turning shaft 31 when the external force does not act on the turning lever 32. In this case, for example, the cam 23 can be formed into a shape in which the first chord 23*a* is formed into a projecting shape or a recessed shape in the center direction. In the embodiment, springs such as the cam returning spring 25 and the coil spring 14 are used as the biasing member. Alternatively, elastic members such as rubber may be used as the biasing member.

In the above configuration, in the section perpendicular to the turning shaft 31, the cam 23 is formed such that the whole contact surface of the cam 23 with the cam receiver 24 is located on the side of the cam receiver 24 with respect to the shaft center 31*b* of the turning shaft 31 when the external force does not act on the turning lever 32.

For example, when the turning lever 32 is turned by 90 degrees, the cam 23 is also turned by 90 degrees in response to the turning of the turning shaft 31. At the position where the cam 23 is turned by 90 degrees, the cam 23 is eccentric with respect to the shaft center 31*b* of the turning shaft 31 in the section perpendicular to the turning shaft 31. Resultantly, the line of action of the force in the returning direction in which the plunger 12 is linearly returned onto the side of the cam 23 by the cam returning spring 25 and coil spring 14 is not matched with the shaft center of the cam 23. For this reason, the moment is generated with respect to the cam 23. Even if the turning lever 32 is turned by 90 degrees, the cam 23 can be turned in the returning direction, and therefore the turning lever 32 can be returned to the original position.

Accordingly, the limit switch 1 that is returned to the original position even if the turning angle of the turning lever 32 becomes 90 degrees can be provided. As described above, the limit switch 1 of the embodiment that is returned to the original position even if the turning angle of the turning lever 32 becomes 90 degrees can be provided. However, the present invention is not limited to the embodiment. For example, the present invention can provide the limit switch 1 that is returned to the original position even if the turning angle of the turning lever 32 exceeds 90 degrees.

In the limit switch 1 of the embodiment, the cam 23 is formed by partially cutting the sectional circular portion in the lengthwise direction of the turning shaft 31, the sectional shape of the cam 23 includes the first chord 23*a* passing through the point on the outer circumferential side with respect to the center of the circular section in the sectional circular portion, and the cam 23 includes the section including the portion on the outer circumferential side with respect to the first chord 23*a*. Resultantly, for example, the cam 23 can be formed into the sectional shape in which the circle is cut by the first chord 23*a*, namely, a partial shape surrounded by the first chord 23*a* in the circle and a smaller arc.

Therefore, the cam 23, which is formed such that the whole contact surface with the cam receiver 24 of the cam 23 is located on the side of the cam receiver 24 with respect to the shaft center 31*b* of the turning shaft 31 when the external force does not act on the turning lever 32 in the section perpendicular to the turning shaft 31, can be provided as a specific example.

In the embodiment, the first chord 23*a* is formed so as to be linearly symmetrical with respect to the turning lever 32. Resultantly, when the external force acts on the turning lever 32, the cam 23 is normally and reversely turned even if the turning lever 32 is normally and reversely turned. Accordingly, the limit switch 1 in which the turning lever 32 is normally and reversely turned can be provided.

In the limit switch 1 of the embodiment, the cam 23 includes the section formed between the first chord 23*a* and the second chord 23*b*. The second chord 23*b* is provided on the outer circumferential side with respect to the first chord 23*a* and is parallel to the first chord 23*a*.

Therefore, the second chord 23*b* is in contact with the cam receiver 24. The second chord 23*b* is formed by a straight line. Therefore, when the external force does not act on the turning lever 32, the bottom including the flat surface of the second chord 23*b* of the cam 23 is in contact with the top including the flat surface of the cam receiver 24. Resultantly, when the external force does not act on the turning lever 32, the cam 23 is stably in contact with the flat surface of the cam receiver 24. Accordingly, the limit switch 1 in which the turning lever 32 is stably held when the external force does not act on the turning lever 32 can be provided.

Preferably, in the limit switch 1 of the embodiment, the turning shaft 31 is connected to the turning lever 32 including the roller 33 at the leading end, the detected object, such as a door, to which the external force is provided, abuts on the roller 33 and presses the roller 33 to turn the turning shaft 31 through the turning lever 32, and the turning lever 32 and the first chord 23*a* of the cam 23 are disposed so as to be orthogonal to each other.

For example, in the case that the given position of the turning lever 32 is set to the vertical direction when the external force does not act on the turning lever 32, the first chord 23*a* of the cam 23 is oriented toward the horizontal direction. Resultantly, the turning lever 32 can surely be turned even when the turning lever 32 is normally or reversely turned up to 90 degrees.

The present invention is not limited to the embodiment, but various changes can be made without departing from the scope of the present invention. An embodiment obtained by properly combining technical means disclosed in the embodiment is also included in the scope of present invention.

The present invention can be applied to the limit switch used as the sensor for positioning or object detection in production facilities or industrial machines.

The invention claimed is:

1. A limit switch comprising:

a turning lever configured to turn by receiving an external force;

a displacement member comprising a cam and a cam receiver, the cam being provided in a turning shaft of the turning lever to be turned in response to turning of the turning shaft that is in contact with the cam, the cam receiver being in contact with the cam and being pressed by the turning of the turning shaft to linearly displace a position of the displacement member;

a switch module configured to perform on and off operations by the linear displacement of the displacement member; and a biasing member configured to bias the displacement member and the turning lever so as to return the displacement member and the turning lever to original positions when the external force is released, wherein, a sectional shape of the cam comprises a first chord and a second chord, the second chord provided on an outer circumferential side of the cam with respect to the first chord, and in a section perpendicular to the turning shaft, the cam is formed such that a whole contact surface of the second chord of the cam with the cam receiver is located on a cam receiver side with respect to a shaft center of the turning shaft when the external force does not act on the turning lever.

2. The limit switch according to claim 1, wherein the cam is formed by partially cutting a sectional circular portion in a lengthwise direction of the turning shaft, the sectional shape of the cam comprises the first chord passing through a point on the outer circumferential side with respect to a center of a circular section in the sectional circular portion, and the cam comprises a section comprising a portion on the outer circumferential side with respect to the first chord.

3. The limit switch according to claim 2, wherein the cam comprises a section formed between the first chord and the second chord, the second chord being provided on the outer circumferential side with respect to the first chord and being parallel to the first chord.

4. The limit switch according to claim 2, wherein the turning lever comprises a roller at a leading end of the turning lever, and a detected object to which the external force is applied abuts on the roller and biases the roller to turn the turning shaft through the turning lever, and wherein the turning lever and the first chord of the cam are disposed so as to be orthogonal to each other.

5. The limit switch according to claim 3, wherein the turning lever comprises a roller at a leading end of the turning lever, and a detected object to which the external force is applied abuts on the roller and biases the roller to turn the turning shaft through the turning lever, and wherein the turning lever and the first chord of the cam are disposed so as to be orthogonal to each other.

* * * * *